United States Patent [19]

Southern et al.

[11] 4,114,251

[45] Sep. 19, 1978

[54] PROCESS FOR PRODUCING ELONGATED METAL ARTICLES

[75] Inventors: Raymond L. Southern, Lower Burrell; Harry L. Bishop, Pittsburgh, both of Pa.

[73] Assignee: Allegheny Ludlum Industries, Inc., Pittsburgh, Pa.

[21] Appl. No.: 615,330

[22] Filed: Sep. 22, 1975

[51] Int. Cl.[2] ..... B22D 11/126

[52] U.S. Cl. ..... 29/527.7; 164/46; 29/DIG. 31; 29/420; 29/DIG. 32

[58] Field of Search ..... 29/420, 420.5, DIG. 31, 29/419, 420.5, 527.7, DIG. 31; 164/46

[56] References Cited

U.S. PATENT DOCUMENTS

| | | | |
|---|---|---|---|
| 2,190,237 | 2/1940 | Koehring | 29/420 |
| 2,289,658 | 7/1942 | Koehring | 29/420 X |
| 2,630,623 | 3/1953 | Chisholm | 29/420 |
| 2,639,490 | 5/1953 | Brennan | 29/420.5 |
| 2,683,305 | 7/1954 | Goetzel | 29/420 UX |
| 2,697,671 | 12/1954 | Brennan | 29/420.5 |
| 2,814,564 | 11/1957 | Hayden | 75/211 |
| 2,870,689 | 1/1959 | Brennan | 75/20 F |
| 2,972,185 | 2/1961 | Brennan | 29/420.5 |
| 3,142,560 | 7/1964 | Storchheim | 75/214 X |
| 3,344,843 | 10/1967 | Miller | 164/46 X |
| 3,533,782 | 10/1970 | Claus et al. | 75/213 |
| 3,545,074 | 12/1970 | Foerster et al. | 29/420.5 |
| 3,670,400 | 6/1972 | Singer | 29/527.7 |
| 3,727,672 | 4/1973 | Grenfell | 164/46 |
| 3,781,968 | 1/1974 | Yamagishi et al. | 29/420 |
| 3,899,820 | 8/1975 | Read et al. | 29/420.5 |

FOREIGN PATENT DOCUMENTS

| | | | |
|---|---|---|---|
| 2,043,882 | 3/1971 | Fed. Rep. of Germany | 164/46 |

*Primary Examiner*—C.W. Lanham
*Assistant Examiner*—V. K. Rising
*Attorney, Agent, or Firm*—Vincent G. Gioia; Robert F. Dropkin

[57] ABSTRACT

There is disclosed a process for producing elongated metal articles by atomizing molten metal in an inert atmosphere and cooling the particles to remove at least some heat of fusion, but not below 40% of the solidus temperature on the centrigrade scale, while they fall onto a bed of particles on a moving support. The particles are then consolidated by means such as passing the bed through rolls to form an elongated metal article.

1 Claim, 3 Drawing Figures

PROCESS FOR PRODUCING ELONGATED METAL ARTICLES

BACKGROUND OF THE INVENTION

The production of elongated metal forms is usually accomplished by casting metal into ingots and then rolling or extruding the cast metal. Many problems are encountered in preparing elongated metal articles in this manner. When rolling cast ingots, the amount of metal in the ingot limits the length of the article that can be made by it. For example, if a strip of indefinite length is to be prepared, it must be prepared by welding strips rolled from adjacent ingots together. In preparing long strip from cast ingots, a great deal of waste is encountered. The ingot itself must be scalped in order to obtain a good surface on the final rolled strip. Ends and sides of the strip must also be trimmed. Experience has shown that as much as 20% of the ingot must be returned to scrap in the process of preparing strip from it.

In all metals, and particularly with alloys, the relatively slow cooling of massive ingots causes differential composition across the cross section of the metal. A slowly cooling alloy will experience fractional crystallization so that the composition of the quickly cooled shell is different from the composition of the more slowly cooled center of the ingot. Even if the composition is the same throughout the cross section of the ingot, the slowly cooled center will have a different grain structure than the shell as a result of different cooling rates. These composition and structural differences show up in end-to-end variation in hot rolled band; and, as mentioned hereinabove, the problems encountered are particularly serious in the preparation of alloys.

Powder metallurgy techniques avoid some of these problems but create others. Powder metallurgy techniques involve atomizing, cooling, screening, cold-compacting, and then heating and hot-compacting of the powder particles. These many processing techniques require high capital and equipment investment. Additionally, in some powder metal processes the surfaces of the individual powder particles are oxidized so that the compacted form contains large quantities of metal oxide. The compacted powder metal from these processes, although very strong, is still in the form of a sintered mass; and it does not have the density or the strength of the parent metal.

Other powder metal processes produce a product at the density of the parent metal, but these processes are very expensive, requiring inert atmospheres and the use and removal of cans. Furthermore, they cannot be used to make strip of indefinite length.

THE INVENTION

This invention provides a method for making elongated metal articles — such as slab, strip, or even metal articles having the shape of an ingot — by a method which avoids the problems of the prior art; and it is especially useful to provide uniformity of composition and grain structure across the cross section of the metal article and from end to end. The process of this invention is akin to powder metallurgy processing, but it avoids many of the costly steps and product deficiencies.

The process of this invention involves producing an elongated metal article, such as slab or strip, by atomizing molten metal in an inert atmosphere, preferably substantially at its melting point. The molten metal is cooled as it falls through the inert atmosphere. It may be cooled to its melting point but with less than all of the heat of fusion removed. It may also be cooled to remove all heat of fusion but not to the extent that it is at a temperature lower than 40% of its solidus temperature on the centigrade scale. Enough heat is removed so that particles become discrete particles, preferably in the form of a plastic material, but at least with a hard enough outer shell to remain as discrete particles when they collect as a bed of such particles on a moving support. The soft particles are then passed through a consolidation means which compresses them into a dense elongated metal article which has a density approaching that of a native metal if it were cast as an ingot and rolled.

The process of this invention is started by providing a molten body of the metal that is to be prepared as an elongated metal article. Desirably, the molten body is protected from oxygen; it composition is adjusted; and it is thoroughly mixed so that its composition is uniform throughout the body. The molten metal is withdrawn from the body and atomized out of contact with oxygen by methods known to the art. The methods known to the powder metallurgy art are particularly desirable, and these will usually be employed.

The preferred method for atomizing the molten metal is by blasting a stream of the molten metal with high pressure, high velocity jets of inert gas. Other atomizing techniques may be used instead of or in combination with inert gas jets — such as the use of ultrasonic vibrations, water-cooled plates, or mechanical spinning devices.

The atomized metal falls through a chamber having an inert gas atmosphere, and in the chamber the metal particles are cooled to remove at least some of the heat of fusion but are not cooled so much as to reduce the temperature below 40% of the solidus temperature on the centigrade scale. Preferably, the body of molten metal is maintained substantially at its melting point, and the atomized particles are cooled to solidification temperature or slightly below it as they fall. The particles are cooled enough to maintain their integrity when they are collected in a bed.

The first essential step of the process of this invention is atomizing molten metal in an inert atmosphere. In the sense of this invention, inert means an atmosphere that does not adversely affect the metal. Typically, the inert atmosphere will be an inert gas such as argon, but it may be a gas such as nitrogen if the character of the metal is such that nitrogen is beneficial or that the metal does not absorb detrimental amounts of nitrogen. The term atomizing is used in this specification in its usual sense to denote subdividing into small discrete liquid particles. As stated above, atomizing is preferably done by blasting a stream of the molten metal with an inert gas; and the inert gas may be employed additionally to supply the inert atmosphere and to cool the particles.

The next essential step in the process of this invention is cooling the atomized metal particles. The particles must be cooled to the extent that they can form a bed of discrete particles that can be consolidated by pressure. The particles may be cooled to remove less than all of their heat of fusion. In that case they preferably are plastic and soft, but they may be cooled to have intact, solid outer shells with soft plastic or liquid interiors. The particles may also be cooled to remove all heat of fusion, but not to a temperature lower than 40% of the solidus temperature on the centigrade scale. The particles cooled in this manner may fall through the inert atmosphere and form as a bed on a moving support maintained beneath the atomizing means. The support may be a separate support or it may be simply a moving bed of particles as will be discussed hereinafter.

The next step in the process is to consolidate the bed of particles to a dense, elongated metal article. Consolidation generally is accomplished with further cooling to insure that the particles in their consolidated form are solid metal. The consolidation process may be done by passing the bed of particles between temperature-controlled rolls which will result in a continuous strip of indefinite length. The consolidation process may also be accomplished by pressing or by extruding the plastic particles.

Since the final, elongated metal article is formed from a large number of very small discrete particles, it is extremely uniform in composition across its cross section and from front to back. Small particles cool so rapidly that fractional solidification is not a significant factor in their cooling process. Even if there is some fractional solidification within a small atomized particle, it does not result in nonuniform composition of metal structure in the final formed elongated article as it does when a large ingot solidifies. When a large ingot solidifies, the composition of the shell may be significantly different from the composition of the center because of fractional solidification; and even if there is no fractional solidification, the slower cooling rate toward the center of the ingot creates metal with different grain structure.

The elongated articles produced by the process of this invention are also different from similar articles made by powder metallurgy techniques. The elongated articles made in accordance with this invention are much more dense when they are consolidated because they are not sintered. Elongated articles made by the process of this invention have a density approaching the density of the metal as it is solidified from the molten form. The method of this invention also avoids the formation of oxides on the surface so that very little metal oxide is incorporated in the composition of the final, consolidated, elongated article. However, like powder metallurgy techniques, the process of this invention provides an opportunity for making elongated metal articles from alloys that are difficult to make by ordinary techniques — such as alloys that are made from metals that would tend to segregate upon solidification if cast as ingots and cooled. The process of this invention also provides an opportunity to make elongated metal articles containing significantly different elements within their structure, such as reinforcing fibers. The process of this invention also differs from those powder metallurgy processes that produce very dense products because those processes are limited to making very small articles, by techniques such as placing the powder in a can, subjecting it to isostatic pressing, and then removing the can.

DETAILED DESCRIPTION

The process of the present invention may be better understood with reference to the accompanying drawings which illustrate various embodiments of this invention.

All of the figures are highly representational and do not include all of the details of construction which are well known to those skilled in this art.

Figure 1:
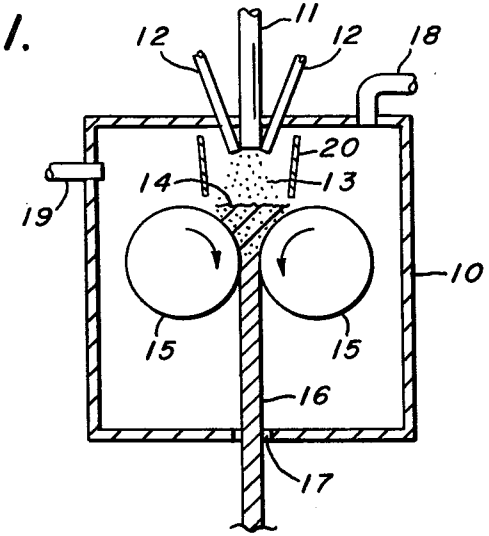
FIG. 1 is a representation in sectional elevation view of a process embodying the present invention.

Referring to FIG. 1, a chamber 10 is provided with a source of molten metal introduced through conduit 11. Conduits 12 are connected to a source of inert gas at high pressure and function as gas jets. The gas jets are arranged in a manner known to the art to subdivide the stream of molten metal issuing from conduit 11 into small particles. The quantity and temperature of gas passing through lines 12 is such that the metal is cooled as it falls as particles 13 upon a bed of particles 14 maintained between two rollers 15. Operation of the rollers in the direction indicated by the arrows causes the bed of particles 14 to move downwardly and be compacted between the rollers into an elongated, solid metal piece 16. Although not shown, a suitable seal in the opening 17 may be provided for avoiding the loss of inert gas which may be exhausted through the conduit 18 for cooling, purification, and recycle. The conduit 19 may be provided, if needed, to provide additional cooling gas. In the embodiment illustrated in FIG. 1, the support for the particles is the bed of particles 14 itself; and it moves downwardly at the same rate that the particles 13 accumulate on its surface. By suitable control of the amount of molten metal introduced through line 11 and the rate at which rollers 15 rotate, the level of the bed of particles 14 may be maintained substantially constant even though the particles are constantly descending and being compacted into a solid element 16. In a preferred embodiment, a baffle 20 is provided to direct to fall of particles 13 onto bed 14.

Figure 2:
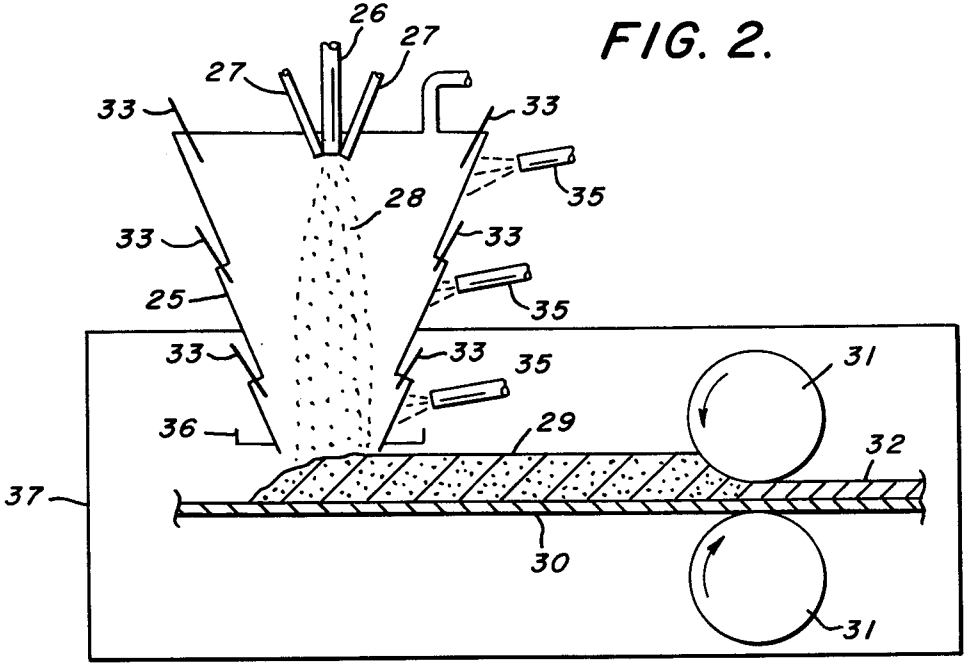
FIG. 2 is a sectional elevation view of another process embodying the present invention.

FIG. 2 illustrates another device embodying this invention. In FIG. 2 a chamber 25 is provided with an inlet 26 for molten metal and inert gas conduits 27 adapted to subdivide the stream of molten metal into particles 28. Particles 28 fall through the chamber 25 and accumulate upon a bed of particles 29 that is maintained on a support 30. The support may be metal that is cooled; and it preferably is provided with a release, such as a mold release, so that the final metal article may be separated from it. The support 30 may be a continuous element or it may be a number of segments that are connected end to end, passed through the process, and returned to the beginning again. The bed of particles 29 passes between rollers 31 where it is compacted to a solid element 32 in the form of a strip of metal.

The chamber 25 may be formed so that it concentrates the falling particles 28 into the form of a stream that is short from front to back in the direction of movement of the bed 29 but is quite wide with respect to the perpendicular direction of that movement. This concentration may be done by use of a number of inert gas jets introduced through the lines 33 which blast the particles in the direction indicated to prevent them from spreading out in a random pattern against the wall of the chamber 25.

The jets 33 may also be controlled with regard to volume and temperature to insure that particles 28 are cooled enough so that they form discrete particles before they become part of the bed 29. If further cooling is needed, it may be provided by cooling the walls of the chamber 25 with water introduced through conduits 35 which maintain the walls of the chamber 25 cool and eventually coolect in the trough 36 to be carried away. A surrounding chamber 37 is provided to maintain a shielded atmosphere surrounding the entire process so that the metal is not contacted with oxygen until the final strip 32 is formed.

Figure 3:
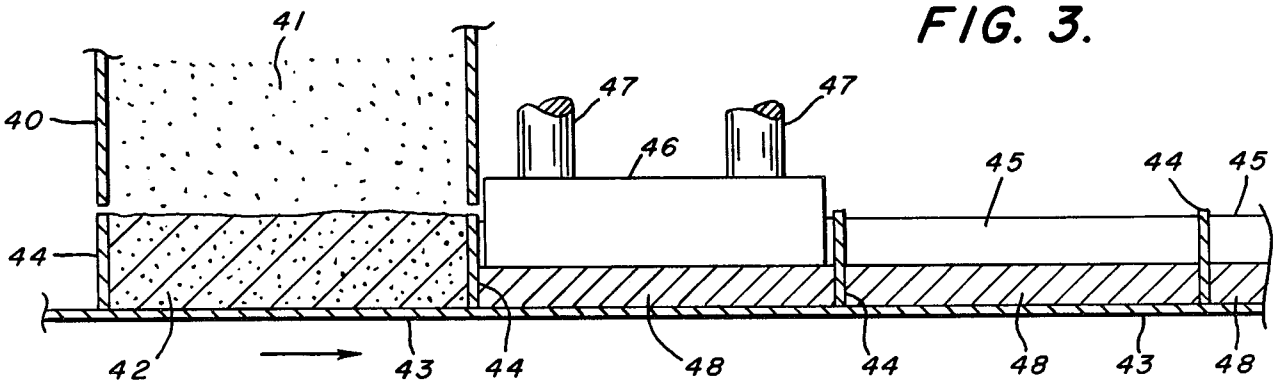
FIG. 3 is a sectional elevation view of another process embodying the present invention.

FIG. 3 illustrates a further embodiment of the process of this invention. In FIG. 3, a gas-filled chamber illustrated at 40 is employed to produce atomized molten particles of metal 41. The chamber 40 may be in the shape of the chamber 25 which is illustrated in FIG. 2 except that it is oriented so that the particles fall in a pattern with their long direction in the direction of the movement of the bed rather than perpendicular to the direction of the movement of the bed. The process illustrated in FIG. 3 is different from the other processes also because the bed does not move continuously but rather discontinuously and in small increments. Thus, the particles 41 fall in the form of a compact bed 42 supported on a bottom platform 43 between the side walls 45 and the end walls 44. The support 43 and side walls 45 cooperate to form a support for the bed 42 that is in the shape of an open-top box. The support 43 with wall members 45 moves intermittently in small increments.

In accordance with the process illustrated in FIG. 3, the support 43 remains stationary until enough particles 41 have fallen to provide a bed of particles of uniform depth under the wall of chamber 40. At that point, the support 43 moves quickly one increment so that the bed of particles 42 advances toward a position beneath the ram 46 that is driven by columns 47 which in turn may be connected to pneumatic, hydraulic, or mechanical means for exerting downward force. The ram 46 is shown in its lower position. In its upper position, the leading edge of ram 46 is raised high enough to clear the top of bed 42. Operation of the ram 46 compresses the bed of particles 42 into a solid, elongated element 48. A surrounding chamber is provided to shield the metal from oxygen until the product 48 is completely formed.

It is evident that may other variations of the process of this invention may be accomplished within the scope of this invention.

We claim:

1. A process for producing an elongated metal article comprising:

A. maintaining a supply of molten metal;

B. providing a stream of molten metal from said supply of molten metal;

C. atomizing said molten metal by blasting said stream of molten metal with an inert atomizing gas to produce a downwardly flowing stream of molten metal particles at the melting temperature of said metal;

D. removing heat from said downwardly flowing particles while in an inert atmosphere to remove at least some heat of solidification but to maintain the particles at a temperature such that the particles are in a plastic condition;

E. directing the resultant downwardly flowing particles directly into the bite of a pair of rotating rolls arranged with their axes substantially horizontal and in substantially the same horizontal plane as to provide a bed of said heated particles in an inert atmosphere;

F. continuing directing said downwardly flowing heated particles onto said bed of said heated particles and continuing rotation of said rolls to consolidate said particles as they pass between said rolls and form said elongated metal article;

G. said atomizing, cooling and consolidating steps being carried out in a closed chamber containing an inert gas.

* * * * *